United States Patent [19]

Hagelberg

[11] 4,031,673

[45] June 28, 1977

[54] CLEANING DEVICE PREFERABLY FOR WATER CLOSETS

[75] Inventor: Anders Torvald Sverker Hagelberg, Molnlycke, Sweden

[73] Assignee: Bengt Petersson New Products Investment AB, Goteborg, Sweden

[22] Filed: Apr. 19, 1976

[21] Appl. No.: 678,208

[52] U.S. Cl. ..... 51/385; 15/104.94; 15/210 R; 51/359; 51/392; 206/15.3

[51] Int. Cl.[2] ..... B24D 15/04; A46B 17/02

[58] Field of Search ..... 51/359, 385, 392, 393; 15/210 R, 104.94; 206/229, 230, 209, 361, 15.3; 312/42, 61

[56] References Cited

UNITED STATES PATENTS

| | | | |
|---|---|---|---|
| 1,786,513 | 12/1930 | Zuckerman | 15/104.94 X |
| 2,648,085 | 8/1953 | Rodgers | 15/210 R |
| 2,755,497 | 7/1956 | Greacen | 15/104.94 |

*Primary Examiner*—James L. Jones, Jr.
*Assistant Examiner*—Nicholas P. Godici
*Attorney, Agent, or Firm*—Toren, McGeady and Stanger

[57] ABSTRACT

A cleaning device for water closets comprising a holder stick device having a handle part and a clamping member which is manually operable between a clamping position and a release position for releasably engaging a cleaning pad intended for usage during only a single cleaning operation. The cleaning pad is constructed of material whereby the pad will disintegrate in water and includes a material disintegratable by means of water and being provided with a cleaning compound. A receptacle arranged to contain a number of the pads laid in a pile one upon the other is arranged to support the holder stick device in a position whereby the clamping member rests against the top pad in a position facilitating clamping of the top pad by the clamping member.

9 Claims, 8 Drawing Figures

CLEANING DEVICE PREFERABLY FOR WATER CLOSETS

The present invention relates to a cleaning device preferably for water closets comprising a holder stick device having a handle part and a clamping member, which by manual operation can be moved between a clamping and a release position in order to releasably hold a cleaning pad intended for single use and made of a material disintegratable in water and preferably provided with a cleaning compound.

In the cleaning of water closets a special brush is usually used. Such a brush has exhibited practical as well as hygienic drawbacks. It has therefore been proposed (see by way of example the British patent specification No. 897,556) to use a pad or cloth of the type to be used once only, and which is clamped in a holder device and is utilized for cleaning, whereafter it is left in the toilet bowl to be flushed away. However, known devices of the prior art do not seem to fulfill their requirements with respect to function and they have not been fully accepted by prospective customers. Thus, these known devices require a complicated procedure in order to attach the pad of the cloth to the holder stick, thereby giving rise to the risk of dripping water. Further, it seems that there has not been anticipated the need of a storage place for the holder stick and the cleaning material which may contain corrosive chemicals and therefore should be made unaccessible to children.

It is an object of the present invention to provide a cleaning device with a holder and a storage receptacle for said holder and said single-use cleaning material, which device is designed in such a manner that it avoids water dripping therefrom, so that the device can be handled in a hygienically attractive manner.

The object of the invention is obtained by means of a device comprising a receptacle arranged to contain a number of cleaning pads laid in a pile one upon the other and arranged to form a support for said holder stick device in such a manner that its handle part is close to the upper portion of the receptacle, which is provided with an opening, and with the clamping means provided to clamp the top pad of the pile by manual operation from the end of the holder stick device located opposite the clamping means and provided with the handle part, the receptacle being designed in such a manner that the holder stick device is supported in such a position that the clampimg means in the position, in which it rests against the top pad, is in position for readily clamping the pad.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments.

An embodiment of the invention is illustrated in the accompanying drawings, in which FIG. 1 is a vertical cross-sectional view along the line I—I in FIG. 2, FIG. 2 is a plan view of the device, FIG. 3 is a partial cross-sectional view along the line III—III in FIG. 2.

Figure 5:
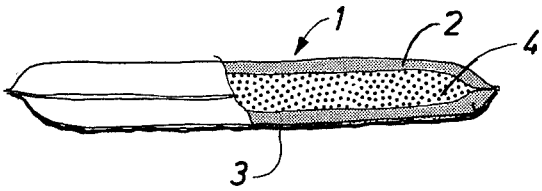
FIG. 5 is a partly broken view of a pad intended for single use and belonging to the device.

The cleanind pad of the invention which is made of material for single use is shown in the form of a pad 1 and in FIG. 5. The pad 1 includes a wrapping envelope 2, preferably of cellulose wadding, which at one side is provided with a glued or otherwise fastened layer 3 of a cleaning compound of soluble and possibly also grinding properties. The envelope 2 encloses a dose 4 of a self acting cleaning compound by way of example of the soda type. The shape of the pad 1 is depicted by the dashed line 5 in FIG. 2. Thus, it is substantially rectangular in shape with one end pointed or rounded.

Figure 8:
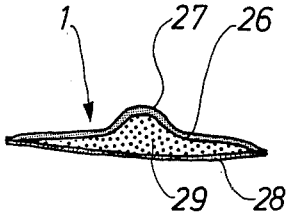
FIG. 8 shows a cross-sectional view of a second embodiment of the pad.

In its second embodiment according to FIG. 8 the pad comprises to different layers. One layer 26 is made of a strong paper with a course surface, which has a good cleaning property, and around the borders of said paper a second layer 28 is attached, which is made of a readily soluble material by way of example cellulose wadding. Between the two layers 26 and 28 a cleaning compound 29 is enclosed. The layer 26 is made with an upwards pointing pleat 27, which will facilitate the attaching of the pad to the holder device, which is described below.

The envelope 2, as already mentioned, is at least in part made of cellulose wadding or of some similar material readily soluble in water. However, it can also be made of a material, which is not easily soluble in water, but then it must instead be composed of several parts, which tend to separate from each other when in contact with water, by way of example having a topside and an underside, which are glued together along their borders by means of a watersoluble glue.

Figure 1:
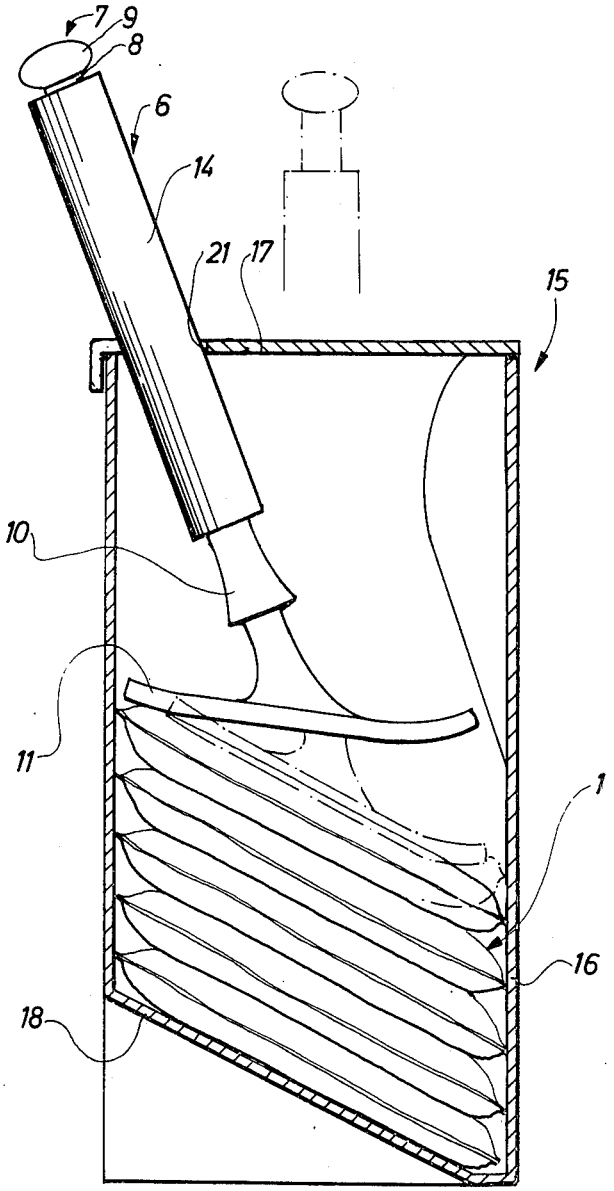
Figure 6:
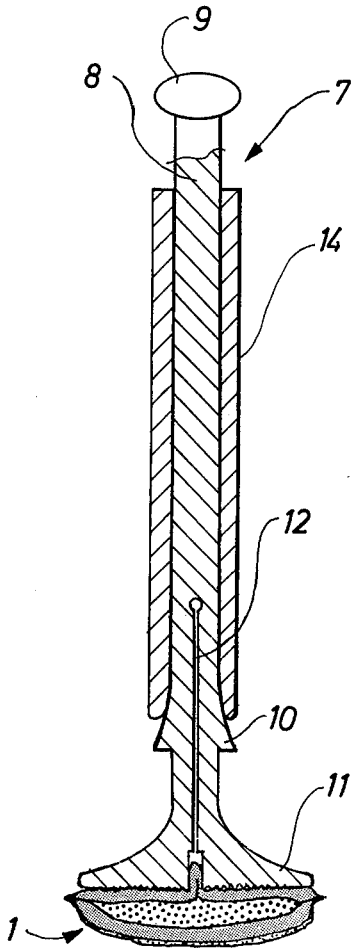
FIG. 6 is a central cross-sectional view through the pad and the holder.
Figure 7:
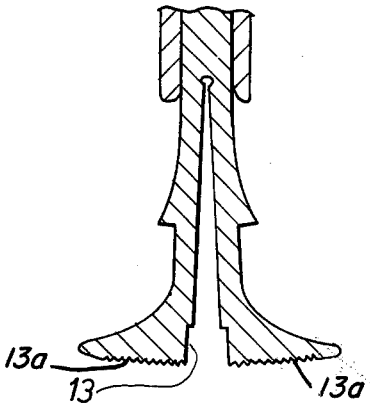
FIG. 7 is a corresponding central cross-sectional view of the holder illustrated in FIG. 6 but in a different condition of use.

The holder stick 6 can be seen in FIG. 1 and in the FIGS. 6, 7 cross-sectional views are shown. The holder stick 6 comprises a main part 7 including a stickshaped part 8 with a knob 9, a conical portion 10 and a spade shaped part 11. The spade shaped part 11, the conical part 10, and a portion of the stickshaped part are formed in a bifurcated configuration divided by a slit 12. At the end of the slit there is a recess 13. The spade shaped part 11 in a front view exhibits a shape, which conforms to the shape of the pad, the part 11, thus, has a contour, which almost conincides with the line 5 in FIG. 2. On the outside of the main part 7 between the conical part 10 and the knob 9 a displaceable sleeve 14 of tubular shape is threaded.

Figure 2:
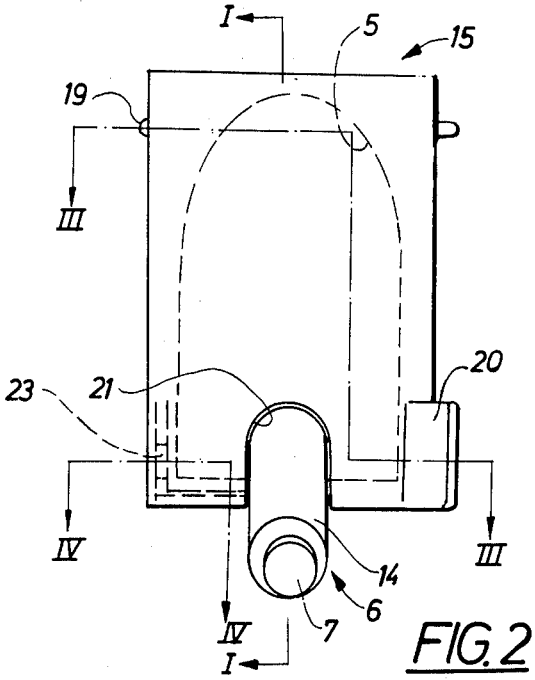

The storage receptacle 15 shown, in FIGS. 1 and 2, comprises a rectangular box 16 with a hinged lid 17. The box 16 has at least in its lower portion a partition wall, which follows the line in FIG. 2, whereby a precise position for the pads 1 and the spade shaped part 11 of the holder stick 6 is obtained, so that they always point in the same direction with the pointed portion, when they are lowered into the box 16. In the box 16 the pads 1 rest against an inclined bottom 18.

Projecting hinge pins 19 are fitted to the box 16 for the hinged lid 17, and in addition the lid is provided with a handle 20 and a recess 21 for the holder stick 6.

The lid 17 is somewhat wider than the box 16 and a spring 22 at one of the hinge pins 19 tends to press the lid to one side. However, the lid 17 against the spring bias of the plate spring 22 can be pressed to the other side, but not in a completely lowered down position, because a pin 23 placed at the opposite end of the lid relative to the hinge pins 19 strikes against the edge of the lid. A hookshaped projection 24 is placed at the same end of the lid, in operative relationship with a similar projection 25 on the outside of the box 16.

Figure 3:
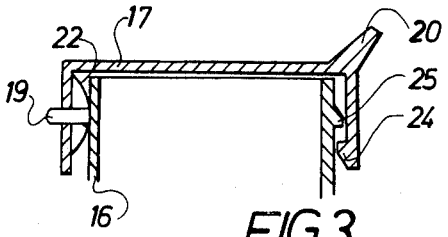
Figure 4:
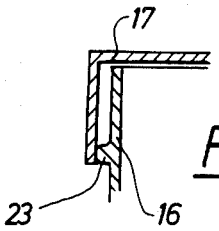
FIG. 4 is a partial cross-sectional view along the line IV—IV in FIG. 2.

The storage receptacle 15 is suitable kept close to the closet, and as is evident from FIG. 1, it will hold a number of pads 1 and the holder stick device 6. The lid may be closed, so that the holder stick 6 extends upwards through the recess 21. In closed position the lid 17 occupies the position illustrated in FIGS. 3, 4, and is pressed to the left by the spring 22 and secured in this position by the shoulder 23. If one tries to open up the lid, the projection 24 will engage the projecting 25, so that the opening is impeded. However, when the edge of the lid has passed the shoulder 23, it can be moved to the right against the bias of the spring 22, so that both the projections 24, 25 are free from each other, and the lid can be completely opened. The opening procedure thus requires several operations and will be difficult to carry out by children.

At an open position of the lid 17 the holder stick 6 (see FIG. 1) can be lowered to the center of the opening of the box 16, so that the spade shaped part 11 rests against the top pad 1. In this position the sleeve 14 may be pressed upwards against the knob 9. Then the two parts of the spade shaped part 11 are free to separate away from each other by springing aside as is shown in FIG. 7. Now the sleeve 14 is moved in a downwards direction, so that it surrounds the conical part 10. This leads to the two parts of the conical portion approaching each other. As a result of friction created by this movement the fairly loose upper layer of the pad 1 is pleated upwards into the recess 13 and is clamped therein.

Serrated surfaces 13a formed on opposite sides of the recess 13 enchance the frictional contact and facilitate gripping of the pad.

The holder stick 6 now is moved upwards out of the receptacle 15 together with the attached pad 1. This like the other pads have been placed in such a manner in the receptacle 15 that their side provided with the layer 3 with cleaning compound is turned outwards from the holder stick 6. This outwardly turned surface can now be used for cleaning of the toilet bowl, in which connection it is handled with the holder stick 6. The layer 3 with cleaning compound facilitates the cleaning.

After cleaning, pressure against the knob 9 moves the sleeve 14 towards the knob, whereby the spadeshaped part 11 again opens up (compare FIG. 7) and the pad 1 falls away down into the water of the toilet bowl. The holder stick 6 can now be shaken free from water, which is an easy task because of its smooth surfaces, whereafter it again is inserted in the receptacle 15, and the lid is lowered down.

The pad 1 is left in the water in the toilet bowl and after a short while the cellulose wadding will be dissolved. A split up of the pad into its constituent different parts can alternatively take place, if it has been made as a compound pad with layers glued together by water soluble glue. By the dissolution of the pad 1 or its split-up the self acting cleaning compound 4 inside the pad will be free and can exert its influence until it is flushed down together with the remaining portions of the pad.

Thus, it will be seen that the parts 10 and 11 of the stick 6 constitute clamping means whereby a cleaning pad 1 may be releasably held, with the clamping means 10, 11 being movable by the action of the sleeve 14 between clamping and release portions.

In connection with the pad according to the second embodiment illustrated in FIG. 8 the layer 28 of cellulose wadding is dissolved almost immediately, whereafter the cleaning compound falls down into the toilet bowl. Thereafter the layer 26, which has not been dissolved and remains attached to the holder stick, is utilized for cleaning. As has been mentioned previously, the paper layer 26 is provided with a course surface, so that it can serve its cleaning purpose in an efficient manner. After cleaning is finished the layer 26 is also loosened from the holder and is left in the toilet bowl to be flushed away, when the cleaning compound has made its effect.

Due to the fact that the only part of the device which comes in contact with soiled surfaces is the pad, which is of the type adapted for one time use only, a very hygienic and esthetically attractive way of cleaning is obtained.

While specific embodiments of the invention have been shown and described in detail to illustrate the application of the inventive principles, it will be understood that the invention may be embodied otherwise without departing from such principles.

I claim:

1. A cleaning device particularly for cleaning water closets, comprising: a holder stick device including a handle portion arranged at one end thereof and clamping means arranged at the opposite end thereof, said clamping means being actuated by manual operation of said handle portion between a clamping position for operably clamping therein a cleaning pad, and a release position for releasing said cleaning pad; a receptacle defining a space configured to store therein a plurality of cleaning pads stacked in a vertical pile one upon another; and a plurality of cleaning pads vertically stacked in a pile in said receptacle, said cleaning pads including a cleaning compound, being adapted for disposal thereof after use in a single cleaning operation, and being made of a material which effects disintegration of said pad in water; said receptacle including a supporting part for supporting said holder stick device in said receptacle by engagement with said handle portion and with said clamping means in a position to facilitate clamping therein of the top cleaning pad in said pile of pads stored in said receptacle to enable withdrawal of said holder stick device from said receptacle with a pad operatively engaged therein for use in a cleaning operation.

2. A cleaning device according to claim 1 wherein said clamping means are formed in a bifurcated configuration including a pair of clamping members defining a slit therebetween within which said cleaning pads may be received for clamping between said clamping members, said clamping members being actuated by manual operation of said handle portion between said clamping position at which said clamping members are brought together to close said slit and clamp therebetween a cleaning pad, and said release position where said clamping members are separated to open said slit to permit a clamped pad to be released and a new pad to be received in said slit for clamping therein.

3. A cleaning device according to claim 2 wherein said holder stick device comprises an elongate unitary member having said handle portion formed at one end thereof and said bifurcated configuration at its opposite end, and a sleeve provided in longitudinal sliding engagement about said elongate unitary member, with sliding movement of said sleeve toward said bifurcated configuration operating to bring said clamping members into said clamping position, and with movement of said sleeve away from said bifurcated configuration operating to permit said clamping members to separate and thereby assume said release position.

4. A cleaning device according to claim 1 wherein said cleaning pads each comprise an outer layer composed of material having abrasive properties to enhance the cleaning action thereof, with said cleaning compound of said pad being contained within said outer layer.

5. A cleaning device according to claim 1 wherein said cleaning compound comprises a self acting cleaning compound enclosed within said pad, said pad being configured to disintegrate in water and thereby to free said cleaning compound therefrom during a cleaning operation.

6. A cleaning device according to claim 1 wherein said pad is impregnated with a deodorizing agent.

7. A cleaning device according to claim 1 wherein said pads and said space defined by said receptacle for storage therein of said pads are shaped in congruent configurations in order to retain said pads therein in a predetermined orientation or facilitate clamping of said pads by said clamping means, said clamping means being also shaped in conformity with said congruent configurations of said pads and said storage space.

8. A cleaning device according to claim 1 wherein each of said pads is formed with an upwardly extending pleat adapted to extend to within said clamping means to facilitate clamping of said pad therein.

9. A cleaning device according to claim 2 wherein said clamping means is formed with serrated surfaces on opposite sides of said slit in order to enhance frictional engagement between said serrated surfaces and said cleaning pad thereby to facilitate gripping of said cleaning pad in clamping position between said clamping members.

* * * * *